US010814334B2

(12) United States Patent
Karl

(10) Patent No.: US 10,814,334 B2
(45) Date of Patent: Oct. 27, 2020

(54) SEPARATION OF THE CONSTITUENTS OF A METALLIFEROUS MIXTURE

(71) Applicant: IFE Aufbereitungstechnik GmbH, Waidhofen/Ybbs (AT)

(72) Inventor: Christian Karl, Gaming (AT)

(73) Assignee: IFE AUFBEREITUNGSTECHNIK GMBH (AT)

( * ) Notice: Subject to any disclaimer, the term of this patent is extended or adjusted under 35 U.S.C. 154(b) by 58 days.

(21) Appl. No.: 16/195,660

(22) Filed: Nov. 19, 2018

(65) Prior Publication Data

US 2019/0160474 A1 May 30, 2019

(30) Foreign Application Priority Data

Nov. 24, 2017 (AT) ..... A 50981/2017

(51) Int. Cl.

| | |
|---|---|
| ***B03C 1/247*** | (2006.01) |
| ***B03C 1/033*** | (2006.01) |
| ***B03C 1/23*** | (2006.01) |
| ***B03C 1/22*** | (2006.01) |

(52) U.S. Cl.

CPC ..... *B03C 1/247* (2013.01); *B03C 1/0332* (2013.01); *B03C 1/0335* (2013.01); *B03C 1/0337* (2013.01); *B03C 1/22* (2013.01); *B03C 1/23* (2013.01); *B03C 2201/20* (2013.01); *B03C 2201/22* (2013.01)

(58) Field of Classification Search

CPC ... B03C 1/0332; B03C 1/0035; B03C 1/0337; B03C 1/22; B03C 1/23; B03C 1/247

USPC ..... 209/212, 217, 218, 225, 228

See application file for complete search history.

(56) References Cited

U.S. PATENT DOCUMENTS

| | | | | |
|---|---|---|---|---|
| 3,448,857 A | | 6/1969 | Benson et al. | |
| 4,083,774 A | | 4/1978 | Hunter | |
| 4,248,700 A | | 2/1981 | Paterson et al. | |
| 4,277,329 A | | 7/1981 | Cavanagh | |
| 4,313,543 A | | 2/1982 | Paterson | |
| 4,834,870 A | * | 5/1989 | Osterberg | B03C 1/247 209/38 |
| 5,057,210 A | * | 10/1991 | Julius | B03C 1/247 209/212 |

(Continued)

FOREIGN PATENT DOCUMENTS

| | | |
|---|---|---|
| DE | 974187 C | 10/1960 |
| DE | 2540372 C3 | 9/1980 |

(Continued)

*Primary Examiner* — Terrell H Matthews

(74) *Attorney, Agent, or Firm* — Raven Patents, LLC

(57) ABSTRACT

A device for separating a metalliferous, lumpy mixture, with a conveyor belt and with a rotating drum in which a fixed magnet system with at least one magnet line is arranged. The separating effect of the device is improved and its complexity is reduced where it is provided that the magnets of the at least one magnet line are arranged such that their poles have the sequence NS SN or SN NS in the circumferential direction, as a result of which the ratio of the maximum radial magnetic flux density to the maximum tangential magnetic flux density on the belt surface, facing the material, in the region of the magnet system is greater than one and, owing to this, the electrically conductive particles are separated out into the first partial stream by radial force action (repulsion).

15 Claims, 2 Drawing Sheets

(56) References Cited

U.S. PATENT DOCUMENTS

| | | | | |
|---|---|---|---|---|
| 2012/0111977 | A1* | 5/2012 | Shuttleworth | B03B 9/061 241/24.25 |
| 2013/0161240 | A1* | 6/2013 | Koslow | B03C 1/247 209/212 |
| 2015/0108047 | A1* | 4/2015 | Rem | B03C 1/30 209/555 |

FOREIGN PATENT DOCUMENTS

| | | | |
|---|---|---|---|
| DE | 3823944 | C1 | 11/1989 |
| DE | 10056658 | C1 | 7/2002 |
| DE | 102009056717 | A1 | 6/2011 |
| DE | 102012014629 | A1 | 1/2014 |
| JP | H08215603 | A | 8/1996 |
| PL | 176665 | B1 * | 7/1999 |

* cited by examiner

SEPARATION OF THE CONSTITUENTS OF A METALLIFEROUS MIXTURE

TECHNICAL FIELD

The invention relates to a device and a method for separating the constituents of a lumpy, metalliferous mixture, which device has a conveyor belt and a rotating drum in which a fixed magnet system is arranged, corresponding to the preamble of claim 1 and of claim 9 and of DE 10 2012 014 629 A1, which is discussed further below.

BACKGROUND

Eddy-current separators with a rotating pole wheel are known for example from JPH08-215603 and DE 974 187 C.

Eddy-current separators with a horizontal pole wheel, that is to say horizontal axle, constitute in the area of secondary treatment (recycling) the prior art for separating non-ferrous metals from a feed mixture, wherein the arrangement of the pole wheel may be configured in an central or eccentric manner (U.S. Pat. No. 3,448,857 and DE 38 23 944 C1). In the case of this sorting technology, the alternating magnetic field of the rapidly rotating pole wheel induces eddy currents in electrically conductive particles, as a result of which they themselves form a magnetic field, which is in the opposite direction to the original one, and a repelling force action therefore results. In this case, the conductive particles generally follow a further trajectory than non-conductors. Moreover, it is generally known that the alternating magnetic field results in electrically conductive particles being acted on not only by a radial force and a tangential force, but also by a moment.

In the case of said eddy-current separators, the pole wheel is equipped along the entire periphery with permanent magnets of alternating polarity and typically rotates at rotational speeds in the range of 2,000-6,000 rpm. Since the permanent magnets normally contain rare earth elements (for example neodymium, samarium), the magnets, in addition to the device for reliably ensuring the high rotational speeds, represent a considerable cost factor.

It has constantly proven to be a problem that the electrically conductive particles already react to the alternating magnetic field, even though they have not yet reached the point of the maximum possible magnetic flux density on the belt surface. While large particles already lift off before they reach the minimum spacing between particle and surface of the pole wheel, small particles start to rotate beforehand, as a result of which the trajectory is subjected to randomizing effects due to further contact with the conveyor belt.

For the sorting of small particle sizes, a pole wheel which is arranged beneath the transport medium so as to be inclined in the conveying direction is proposed in DE 10 2009 056 717 A1, it however being necessary in the case of this device for multiple pole wheels to be arranged next to one another for the purpose of achieving a high throughput capacity.

It is generally known that the separating process of the eddy-current sorting is generally a two-product separation (non-ferrous metals, non-metals), wherein ferromagnetic constituents (iron, steel) are separated out by means of magnet drums or magnets over a belt prior to the feeding to the eddy-current separator. It should be mentioned as disadvantageous that a considerable fraction of metals (especially weakly magnetic [rust-resistant] VA steel) is still present in the partial stream of the non-metals, said metals not passing into the partial stream of the non-ferrous metals owing to the ratio of electrical conductivity to density being too low.

According to DE 100 56 658 C1, blowing-out of valuable VA fractions from the partial stream of the non-metals by way of a combination of metal detection coils and nozzle bars has been attempted, this however resulting in the throughput capacity of the eddy-current separator being reduced.

For inducing eddy currents in electrically conductive particles, however, it is not necessary for the magnet system to be movable, but it is sufficient if there is a relative speed between the particles of the feed mixture and the magnet system, which speed can also be brought about by movement of the particles alone. This type of design results in electrically conductive particles being braked or deflected laterally during movement through the magnet system according to the arrangement thereof, whereas non-conductors are not influenced.

To that effect, in the area of secondary treatment, devices and methods have already been tested (DE 25 40 372, U.S. Pat. Nos. 4,083,774, 4,248,700, 4,277,329 and 4,313,543), which, however, exhibited differences of the relative speed which were too small with an open pole system, or achieved only low throughput capacities with a closed magnet system owing to a narrow gap width.

In DE 10 2012 014 629 A1, mentioned in the introduction, a device which is similar to the eddy-current separators with a central or eccentric pole wheel is described, the magnet system in the deflecting drum however being designed in a fixed manner as a permanent magnet line, electromagnet line or a superconducting magnet line, as a result of which, according to the laid-open specification, electrically conductive particles, such as non-ferrous metals (aluminum, copper, zinc, tin, brass, bronze), copper cables, electronic boards and high-grade steels are braked by eddy-current effects. However, it proves to be disadvantageous that weakly magnetizable particles (for example VA steel) can remain attached in the vicinity of the magnet system and thus weaken the magnetic field and adversely affect the separation success.

SUMMARY

The invention is therefore based on the object of specifying a device and a method for separating a metalliferous, lumpy mixture which does not have the disadvantages mentioned and which is able to separate the individual constituents reliably and precisely.

According to the invention, said aims are achieved by a device and a method having the features specified in the characterizing part of claim 1 and claim 9, respectively. In other words, in the case of a device defined in the introduction in that the magnets of the at least one magnet line are arranged such that their poles have the sequence NS SN or SN NS in the circumferential direction, with the result that the ratio of the maximum radial magnetic flux density to the maximum tangential magnetic flux density on the belt surface in the region of the magnet system is greater than one. In this way, the electrically conductive particles are separated out into a separate partial stream by radial force action (repulsion).

Consequently, for belt speeds at or above 2 m/s, the formation of sufficiently strong eddy currents and, in the radial direction, correspondingly large repulsive forces is achieved. Said large forces and the high belt speed allow high mass throughputs. Weakly magnetizable particles (for example VA steel) are thus not able to remain attached in the vicinity of the magnet system, as a result of which weakening of the magnet field is reliably avoided and the degree of separation success remains high at all times.

In one configuration, there is provided along the periphery an extension of said magnet system, following in the direction of movement of the belt, with multiple poles of relatively low flux density but identical pole arrangement for attracting weakly magnetizable constituents, by way of which a partial stream of non-ferrous metals is separated out of the feed mixture by means of a splitter as a result of the formation of eddy currents, a further partial stream consisting of non-metallic particles (plastic, mineral material, glass, etc.) is not influenced by the magnetic field, and a third partial stream consisting of weakly magnetizable constituents (especially austenitic VA steel) is separated out by magnetic force action and by way of a second splitter.

According to the invention, the feed mixture is guided by means of a conveying device over the fixed magnet system, which is positioned in the rotating belt drum, and is preferably designed as a conveyor belt which, according to a particularly preferred embodiment, is rough or profiled on the side facing the material. The roughness or profiling may range from half a millimeter to one centimeter, the geometry which is used in the higher region may consist of mutually parallel or mutually crossing strip-like projections, of knobs or the like and serves the purpose of weakly magnetizable particles present also being moved further with the belt in the region of the magnet system as a result of the increased friction and not being detained in the region of the magnet system and the belt gliding through below them.

According to the invention, a fixed magnet system with a high magnetic flux density is arranged in the belt drum, wherein, according to a preferred embodiment, said system is able to be rotated about the center of the belt drum at least within limits, as a result of which the lift-off point of electrically conductive particles can be influenced for the purpose of increasing the separation efficiency. The position of the magnet system is normally located in the region in which the belt runs onto the drum, and thus at the uppermost point of the drum (12 o'clock) in the case of a horizontal belt, the pivotability here comprising in most cases a range of ±5° about this base position. If an inclined belt is used, a small number of tests with the respective material suffices to achieve an optimum.

According to the invention, it is advantageously possible to reduce the construction and material costs owing to the fixed magnet system, since costly devices for ensuring the high rotor rotational speeds, for mounting and cooling are not necessary.

The design of the magnet system is, as already mentioned, realized according to the invention such that, on the belt surface in the region of the magnet system (this substantially amounting to a length measured in the running direction of the belt, which is twice the length of the magnet system in said direction), the ratio of the maximum radial flux density to the maximum tangential flux density is greater than one, which results also in the force action in the radial direction on electrically conductive particles by way of formation of the eddy currents dominating the tangential force, and the particles consequently being repelled and passing into the appropriate partial stream. Compared with a fixed magnet system which brakes the electrically conductive particles by way of formation of eddy currents, this arrangement proves to be advantageous since particle-particle interactions in the separation region are reduced and thus the sorting result is improved.

For the purpose of ensuring the desired ratio of radial flux density to tangential flux density, the magnet system consists in this case of at least one magnet line (of a row of magnet units arranged along a generator of the cylindrical surface), wherein the arrangement thereof is designed such that one magnet line in each case consists of two magnet rows, which are, in cross section, magnetized tangentially with respect to the drum periphery and are opposite one another with like magnet poles, and between which a ferromagnetic bar is arranged. Here, the gap and thus the bar may either broaden radially outwardly or have constant width.

The design according to the invention of the magnet system, according to which the force action based on the formation of eddy currents in electrically conductive particles is limited to a narrow region by the arrangement of preferably one magnet line, is also particularly expedient in that the maximum of the magnetic flux density occurs in an almost abrupt manner on the belt surface in the direction of movement of the particles, as a result of which large particles are not repelled too early and small particles do not start to roll prematurely.

It is also advantageous that the magnets do not have to be arranged along the entire periphery of the deflecting drum, this leading to cost savings.

According to one preferred embodiment, the magnet system in the deflecting drum may be designed with an extension along the periphery in the direction of movement of the belt. Said extension is preferably of multi-pole design and, if appropriate, able to be rotated together with the magnet system about the center of the drum, wherein it is provided that the magnet poles of the extension have, on the surface, a significantly lower magnetic flux density than the magnetic flux density of the magnet system, row by row preferably not more than in each case 30%. Here, the number and the arrangement of the magnets of the extension are freely selectable within wide limits, wherein preferably, as with the (actual) magnet system, the arrangement consists of polarized magnet rows which are opposite one another tangentially with respect to the periphery with like poles and which have a ferromagnetic bar therebetween or magnets arranged radially with alternating polarity. According to the invention, as a result of this configuration, it is achieved that weakly magnetic particles pass into the third partial stream owing to the magnetic force action, as a result of which, in addition to non-ferrous metals in the first partial stream and non-metals in the second partial stream, a further useful partial stream results.

Since both the magnet system and the extension of the magnet system are able to be installed over the entire width of the transport device, high throughput capacities are also achievable.

According to the invention, the magnet system and the extension preferably consist of a permanent magnet arrangement, it also being possible however for the design according to the invention to have an electromagnet arrangement or a superconducting arrangement.

BRIEF DESCRIPTION OF THE DRAWINGS

The invention will be explained in more detail below on the basis of the drawing, in which.

DETAILED DESCRIPTION

Figure 1:
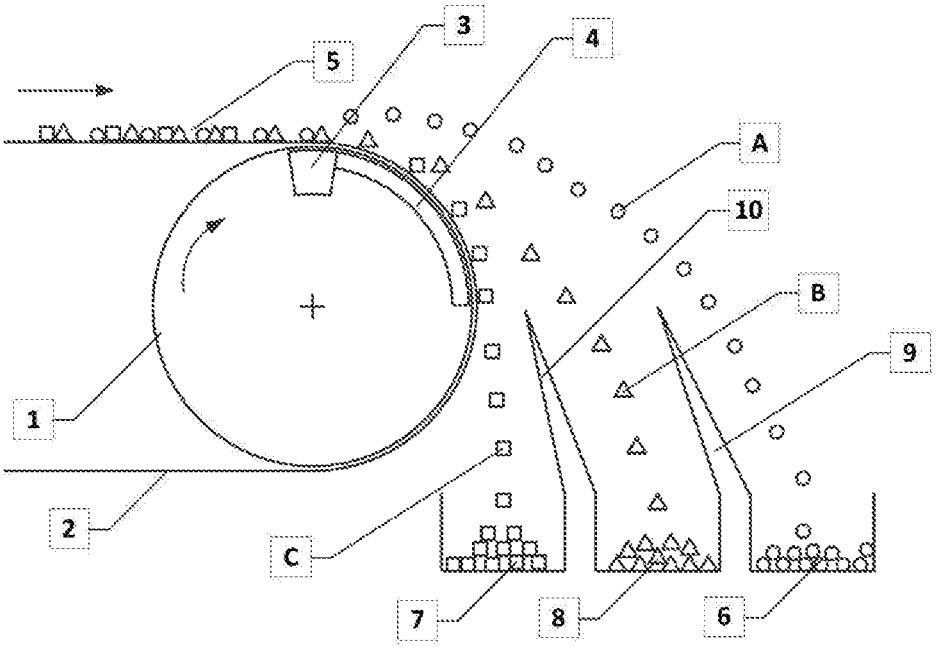
FIG. 1 shows the device according to the invention with a fixed magnet system and an extension of the magnet system, and the two splitters for sorting the feed mixture into the partial streams A, B and C, FIG. 2 schematically shows the magnet system, the magnetic field lines, and the forces of the device according to the invention that act on an electrically conductive particle.

According to FIG. 1, the device consists of a rotating drum 1 with a conveyor belt 2, in which drum the fixed magnet system 3 and the extension 4 are arranged. Here, the surface of the conveyor belt 2 is, as already mentioned, preferably not of smooth design, but of profiled design. However, the extension 4 of the magnet system 3 does not amount to a prerequisite for the function according to the invention, but constitutes a configuration. A mixture 5 obtained from metal recycling, for example, is fed via the drum 1, wherein said mixture consists inter alia of non-ferrous metals 6 (for example aluminum, copper, lead), weakly magnetic metals 7 (for example VA steel) and non-metals 8 (for example plastic, rubber).

As already described, the required relative speed between the magnet system 3 and the feed mixture 5 is achieved by the high speeds of the conveyor belt 2 of at least 2 m/s, preferably at least 4 m/s, and particularly preferably of at least 5 m/s.

The non-ferrous metals 6 pass into the first partial stream A by way of the splitter 9 owing to the formation of eddy currents during the movement over the magnet system 3 and to the resulting repelling force action on said non-ferrous metals, the non-metals 8 pass into the second partial stream B without being influenced, with the exception of particle-particle interactions, and weakly magnetic metals 7 pass into the third partial stream C by means of the splitter 10 owing to the magnetic force action of the magnet system 3 and of the extension 4.

As already described, in a refinement of the invention, for the purpose of controlling the lift-off point of the non-ferrous metals 6, both the magnet system 3 and the extension 4 thereof are able to be rotated about the center of the belt drum 1 and the magnetic flux density of the extension 4 is, on the belt surface, lower than the magnetic flux density of the magnet system 3.

Figure 2:
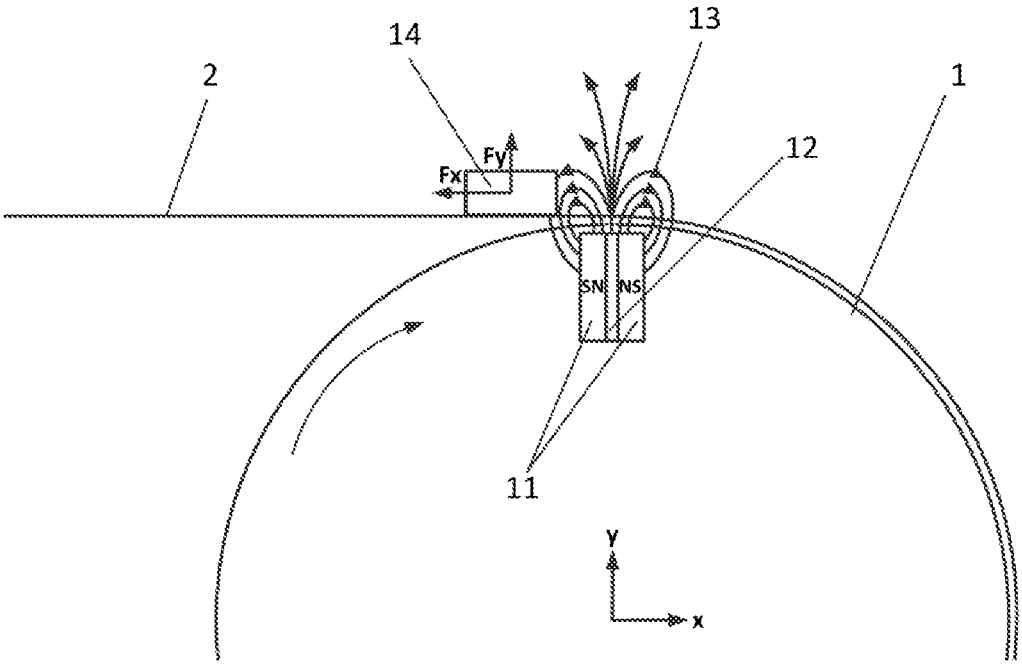

FIG. 2 schematically shows the device according to the invention, and visible here are the magnet system 3 with a magnet line consisting of two magnet rows 11, which are, in cross section, polarized tangentially with respect to the drum periphery and are opposite one another with like poles, and the ferromagnetic bar 12 which is positioned between the poles, the magnetic field lines 13 of the magnet system 3 and the forces acting on an electrically conductive particle 14 owing to the formation of eddy currents. The "region of the magnet system" is, as can be seen from the illustrated magnetic lines, approximately twice as long in the direction of movement as the magnet system and can be up to three times as long, the extension 4 (FIG. 1) not being considered in this case.

Clearly visible here is the advantage of the fixed magnet system 3 with a magnet line in comparison with eddy-current separators with a rotating pole wheel, according to which an electrically conductive particle 14 substantially reaches the maximum flux density on the surface of the conveyor belt 2 while, according to the prior art, said particle already experiences a repelling force action even though it has not yet reached the maximum flux density on the surface of the conveyor belt.

Figure 3:
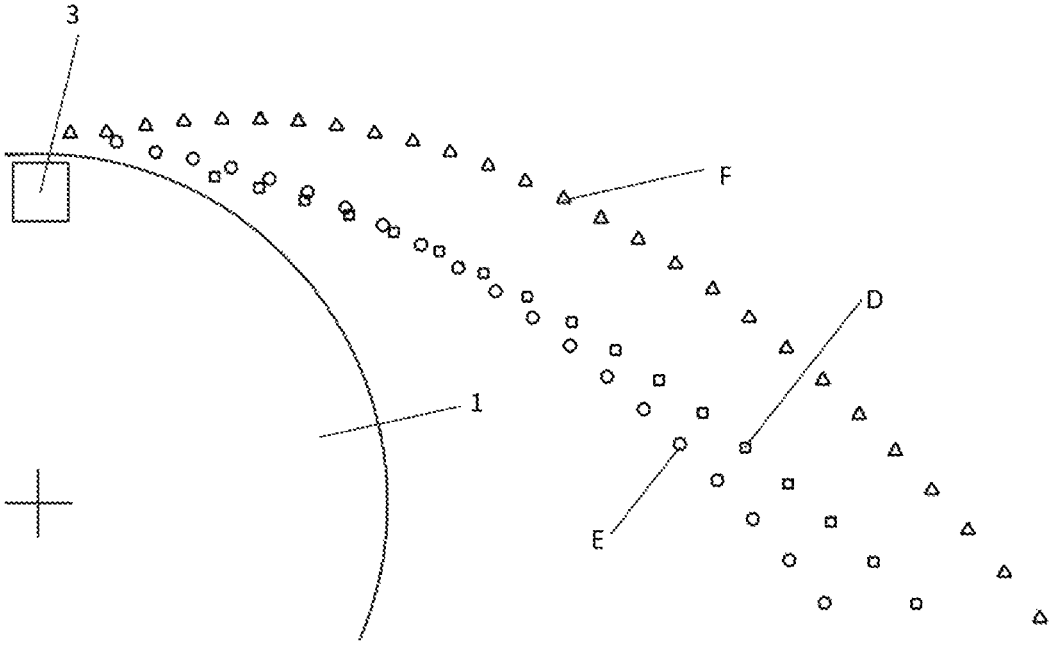
FIG. 3 shows the belt drum and three trajectories, recorded by means of a camera system, from a test series carried out with identical electrically conductive particles.

FIG. 3 shows the result of a test series which was carried out. Here, as test bodies, use was made of disks with a diameter of 20 mm, a height of 3 mm and an electrical conductivity of 21 MS/m. The speed of the conveyor belt was 3 m/s.

Here, the trajectory of the partial stream D constitutes the ballistics without the use of a magnet system. Whereas for partial stream E a braking magnet system as proposed in DE 10 2012 014 629A1 was used, partial stream F corresponds to the trajectory with use being made of the magnet system 3 of the device according to the invention without an extension 4. The difference between the partial streams E and F can clearly be seen, according to which electrically conductive particles are braked in the case of partial stream E and are radially repelled in the case of partial stream F.

Moreover, the advantage of the use of the device according to the invention can be seen in that, in the case of partial stream F, in contrast with partial stream E, no crossing occurs, and thus also no resulting particle-particle interactions occur, with the partial stream D during the flying phase.

The geometric region for determining the flux density "on the belt surface, facing the material, in the region of the magnet system" is to be understood as meaning that it is delimited in the circumferential direction by the imaginary extensions of the diameters through the belt drum, which diameters just touch the magnet system in a tangential manner, and in the radial direction by the outer belt surface and one centimeter therebeyond. The respective absolute values of the flux density are to be taken as a result of the at least approximately symmetrical formation of the magnetic field.

Since, according to the invention, the magnets of the at least one magnet line 11 are arranged such that their poles have the sequence NS SN or SN NS in the circumferential direction, as a result of which the ratio of the maximum radial magnetic flux density to the maximum tangential magnetic flux density on the belt surface, facing the material, in the region of the magnet system 3 is greater than one. Owing to this, the electrically conductive particles are separated out into a first partial stream (A) by radial force action (repulsion).

The method according to the invention for separating a metalliferous mixture 5, wherein a first partial stream A of non-ferrous metals 6 is separated out by eddy-current sorting by means of a splitter 9 and a second partial stream B composed of non-metals 8 is not influenced, is characterized in that a third partial stream C composed of weakly magnetic particles 7 is, through the use of a device as explained, and as defined in claims 1 to 7, separated out by magnetic force action of the magnet system 3 or of the extension 4 by way of a splitter 10.

It should also be pointed out that, in the description and the claims, specifications such as "largely" mean more than half, preferably more than ¾; thus, in the case of the composition of materials, over 50% by weight, preferably over 80% by weight, and particularly preferably over 95% by weight; that "lower region" of a reactor, filter, structure or a device or, very generally, an object means the lower half and in particular the lower quarter of the total height, "lowermost region" means the lowermost quarter and in particular an even smaller part; while "middle region" means the middle third of the total height. All of these specifications have their generally accepted meaning, applied to the as-intended position of the object being considered.

In the description and the claims, the terms "front", "rear", "top", "bottom" and so on are used in the generally accepted form and with reference to the object in its normal position of use. That is to say that, in the case of a firearm, the mouth of the barrel is at the "front", that the breech or slide is moved toward the "rear" by the explosion gases, that material on a belt or conveyor belt is moved therewith toward the "front", etc.

In the description and the claims, "substantially" means a deviation of up to 10% of the specified value, if physically possible both downward and upward, otherwise only in the direction that makes sense, ±10° consequently being meant for degree specifications (angle and temperature). With designations as in "a solvent", the word "a" is not to be regarded as a numeral but as a pronoun, if nothing to the contrary emerges from the context.

The term "combination" or "combinations", unless specified otherwise, stands for all types of combinations, proceeding from two of the relevant constituent parts up to a multiplicity of such constituent parts, and the term "containing" also stands for "consisting of".

The features and variants specified in the individual configurations and examples may be freely combined with those of the other examples and configurations, and in particular may be used for characterizing the invention in the claims without the forcible inclusion of the other details of the respective configuration or of the respective example.

| List of reference signs: | |
|---|---|
| 1 | Drum |
| 2 | Conveyor belt |
| 3 | Magnet system |
| 4 | Extension |
| 5 | Feed mixture |
| 6 | Non-ferrous metals |
| 7 | Weakly magnetic particles |
| 8 | Non-metals |
| 9 | Splitter 1 |
| 10 | Splitter 2 |
| 11 | Magnet row(s) |
| 12 | Ferromagnetic bar |
| 13 | Field lines |
| 14 | Electrically conductive particle |
| A | First, non-ferrous metal stream |
| B | Second, non-metallic stream |
| C | Third, weakly metallic stream |
| D | Trajectory for ballistics |
| E | Trajectory for braking magnet system |
| F | Trajectory for magnet system according to the invention |

What is claimed:

1. A device for separating a metalliferous mixture of materials, comprising:

a conveyor belt configured to convey the mixture of materials;

a rotating drum supporting the conveyor belt;

a fixed magnet system arranged in the drum, such that the magnet system does not rotate as the drum rotates where the magnet system includes at least one magnet line in which magnets are arranged so that their poles have a sequence NS SN or a sequence SN NS in a direction that is circumferential relative to the drum, with a result that a ratio of the maximum radial magnetic flux density to a maximum tangential magnetic flux density on a surface of the belt facing the materials in a region of the magnet system is greater than one;

such that non-ferrous metals in the mixture of materials are separated by a splitter into a partial stream by force action, due to a formation of eddy currents in electrically conductive particles in the mixture of materials.

2. The device of claim 1, wherein the magnet system consists of precisely one magnet line.

3. The device of claim 1, wherein a ferromagnetic bar is positioned between the magnets of the magnet line.

4. The device of claim 1, wherein the magnet system can be rotated about the center of the drum.

5. The device of claim 1, wherein the magnet system includes an electromagnet arrangement or a superconducting magnet arrangement.

6. The device of claim 1, wherein the magnet system has an extension, and the magnetic poles thereof have a lower magnetic flux density on the belt surface than that of the magnet system.

7. The device of claim 6, wherein the extension of the magnet system has a multi-row design.

8. The device of claim 7, wherein the extension of the magnet system can be rotated about the center of the drum.

9. The device of claim 7, wherein the extension of the magnet system includes an electromagnet arrangement or a superconducting magnet arrangement.

10. The device of claim 1, wherein the conveyor belt has a rough or profiled design.

11. The device of claim 1, wherein a speed of the conveyor belt speed is over 2 m/s.

12. The device of claim 11, wherein the speed of the conveyor belt is over 4 m/s.

13. The device of claim 11, wherein the speed of the conveyor belt is over 5 m/s.

14. A method for separating a metalliferous mixture of materials, comprising:

separating a first partial stream of non-ferrous metals from the mixture of materials by eddy-current sorting with a device according to claim 1, by way of a splitter;

failing to influence a second partial stream of non-metals; and separating a third partial stream of weakly magnetic particles from the mixture of materials by magnetic force action of a magnet system of the device according to claim 1, by way of a splitter.

15. A method for separating a metalliferous mixture of materials, comprising:

separating a first partial stream of non-ferrous metals from the mixture of materials by eddy-current sorting with a device according to claim 7, by way of a splitter;

failing to influence a second partial stream of non-metals; and separating a third partial stream of weakly magnetic particles from the mixture of materials by magnetic force action of an extension of the magnet system of the device according to claim 7, by way of a splitter.

* * * * *